US009109827B1

(12) United States Patent
Williams

(10) Patent No.: US 9,109,827 B1
(45) Date of Patent: Aug. 18, 2015

(54) REVOLVING FRAMED REFRIGERATOR DEVICE

(71) Applicant: Lorrita D. Williams, Seattle, WA (US)

(72) Inventor: Lorrita D. Williams, Seattle, WA (US)

( * ) Notice: Subject to any disclaimer, the term of this patent is extended or adjusted under 35 U.S.C. 154(b) by 0 days.

(21) Appl. No.: 14/479,913

(22) Filed: Sep. 8, 2014

(51) Int. Cl.
*F25D 11/00* (2006.01)
*F25D 23/02* (2006.01)
*F25D 27/00* (2006.01)

(52) U.S. Cl.
CPC ..... *F25D 11/00* (2013.01); *F25D 23/025* (2013.01); *F25D 27/005* (2013.01)

(58) Field of Classification Search
CPC ..... A47F 3/04; A47F 3/0426; F25D 23/00; F25D 2300/00; F25D 2323/00; F25D 2323/011; F25D 2327/001; F25D 2400/00; F25D 2400/18; F25D 2500/02
See application file for complete search history.

(56) References Cited

U.S. PATENT DOCUMENTS 1,883,961 A * 10/1932 Kosmerl ..... 62/297
2,507,834 A * 5/1950 Storer et al. ..... 62/229
2,811,020 A * 10/1957 Formoso ..... 62/297
3,365,907 A * 1/1968 Barroero ..... 62/256
3,712,570 A * 1/1973 Stone et al. ..... 248/133
4,436,335 A * 3/1984 Yoos ..... 296/168
4,725,107 A 2/1988 Appleton
4,974,801 A * 12/1990 Pulsifer ..... 248/181.2
5,090,784 A * 2/1992 Battista ..... 312/204
5,277,488 A * 1/1994 Cleary et al. ..... 312/408
6,971,250 B1 * 12/2005 Imre et al. ..... 62/441
6,990,828 B2 1/2006 Kim et al.
7,334,425 B1 * 2/2008 Johnson ..... 62/440
2004/0069787 A1 * 4/2004 Gruennert et al. ..... 220/503
2004/0118141 A1 * 6/2004 Kim et al. ..... 62/258
2006/0278384 A1 * 12/2006 Viel ..... 165/257
2009/0084124 A1 * 4/2009 Hayase ..... 62/255

* cited by examiner

*Primary Examiner* — Daniel Rohrhoff
(74) *Attorney, Agent, or Firm* — Crossley Patent Law

(57) ABSTRACT

A revolving framed refrigerator device having an inverted U frame having an interior side, a top end, a pair of spaced apart legs, and a center, a motor disposed within the frame proximal the center, a rotation control disposed on one leg, the rotation control in operational communication with the motor, a multi-doored refrigerator disposed within the frame, the refrigerator having a front side spaced apart from a back side, a first side spaced apart from a back side, a top side spaced apart from a bottom side, the top side connected to the motor, a plurality of doors disposed on the front side, a plurality of doors disposed on the back side, and a bearinged base wherein the rotation control rotates the refrigerator to a desired position.

2 Claims, 3 Drawing Sheets

REVOLVING FRAMED REFRIGERATOR DEVICE

BACKGROUND OF THE INVENTION

Various types of revolving refrigerators are known in the prior art. Most greatly alter refrigerator design beyond what a vast majority of users are accustomed to. The concept, though, of accessing a refrigerator's contents from more than only a front side is a sound one. What is needed is revolving framed refrigerator device that features a multi-doored refrigerator that resembles customary refrigerator design, and one that is sturdily surrounded by a supportive framework with lighting and controls.

FIELD OF THE INVENTION

The present invention relates to refrigerators, and more particularly, to revolving framed refrigerator device.

SUMMARY OF THE INVENTION

The general purpose of the revolving framed refrigerator device, described subsequently in greater detail, is to provide a revolving framed refrigerator device that has many novel features that result in a revolving framed refrigerator device which is not anticipated, rendered obvious, suggested, or even implied by prior art, either alone or in combination thereof.

To accomplish this, the revolving framed refrigerator device comprises an inverted U frame having an interior side, a top end, a pair of spaced apart legs, and a center. A bearing is disposed within the center and extended through the interior side. A motor is disposed within the frame proximal the center. An axle is disposed within the bearing. A geared connection connects the motor to the axle.

A light is disposed within the interior side proximal the center. A trim light is disposed substantially throughout the interior side. Both light and trim light are of significant benefit to a user's visibility. A light control is disposed on one leg. The light control is in operational communication with the light and the trim light. A rotation control is disposed on one leg. The rotation control is in operational communication with the motor. Of important note is that the refrigerator is sturdily supported both above and below and sufficiently bearinged to easily turn with little motor power.

A multi-doored refrigerator is disposed within the frame. The refrigerator has a front side spaced apart from a back side, a first side spaced apart from a second side, and a top side spaced apart from a bottom side. The axle is connected to the top side. A plurality of doors is disposed on the front side. A plurality of doors is disposed on the back side. A bearinged base is disposed immediately adjacent the bottom side. It is important to note that the refrigerator design, other than accessory doors on the back side, is that of the most widespread accepted use. The rotation control rotates the refrigerator to a desired position.

Thus has been broadly outlined the more important features of the present revolving framed refrigerator device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
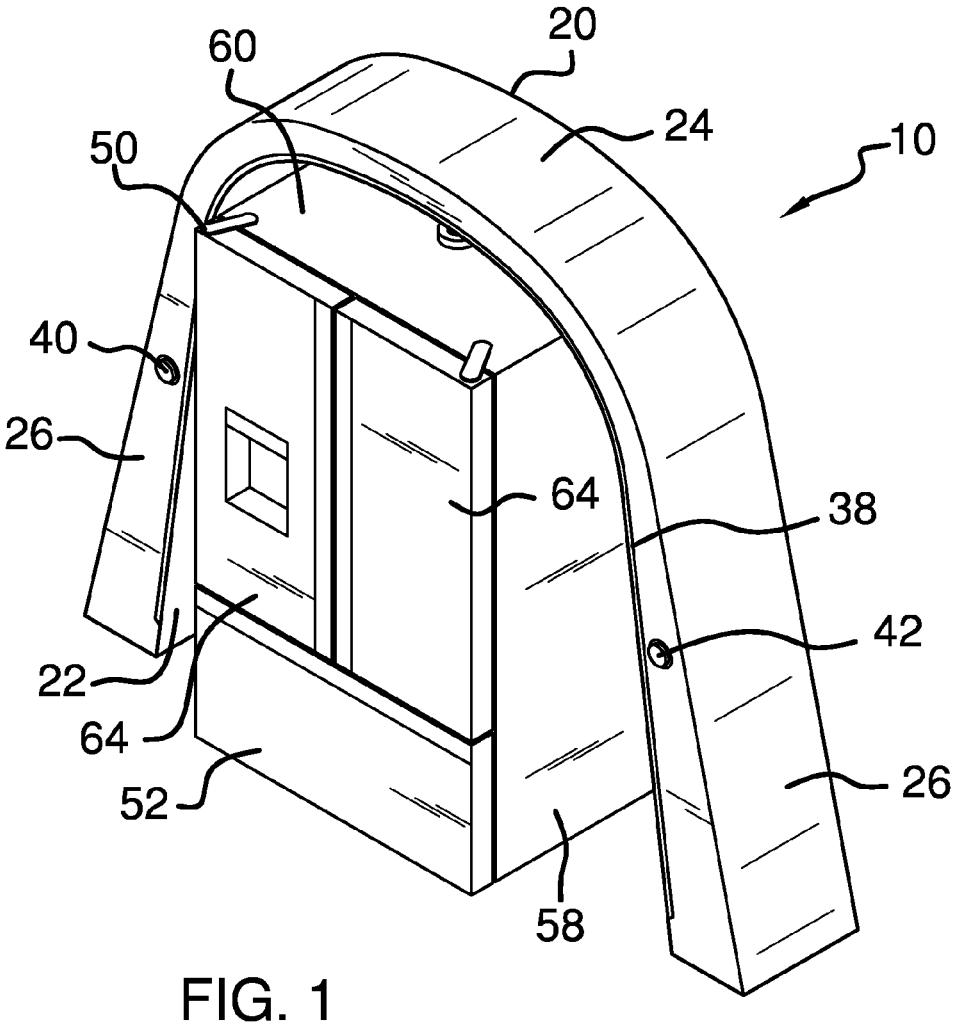
FIG. 1 is a top end perspective view.
Figure 2:
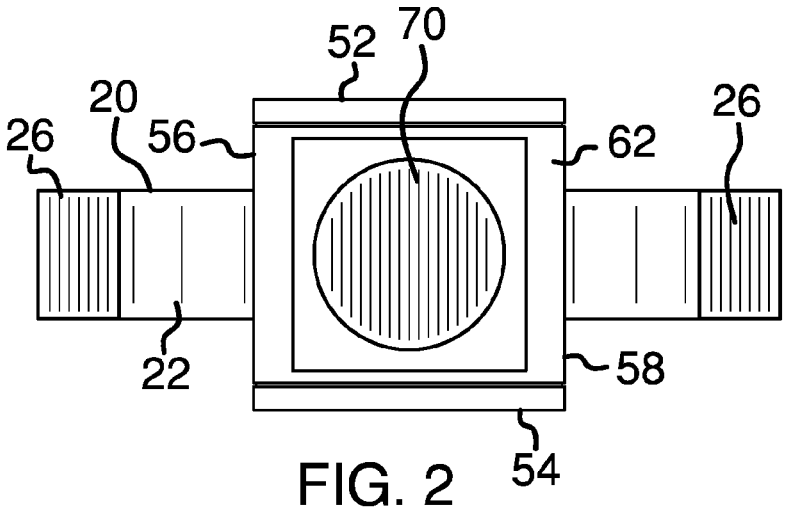
FIG. 2 is a bottom plan view.
Figure 3:
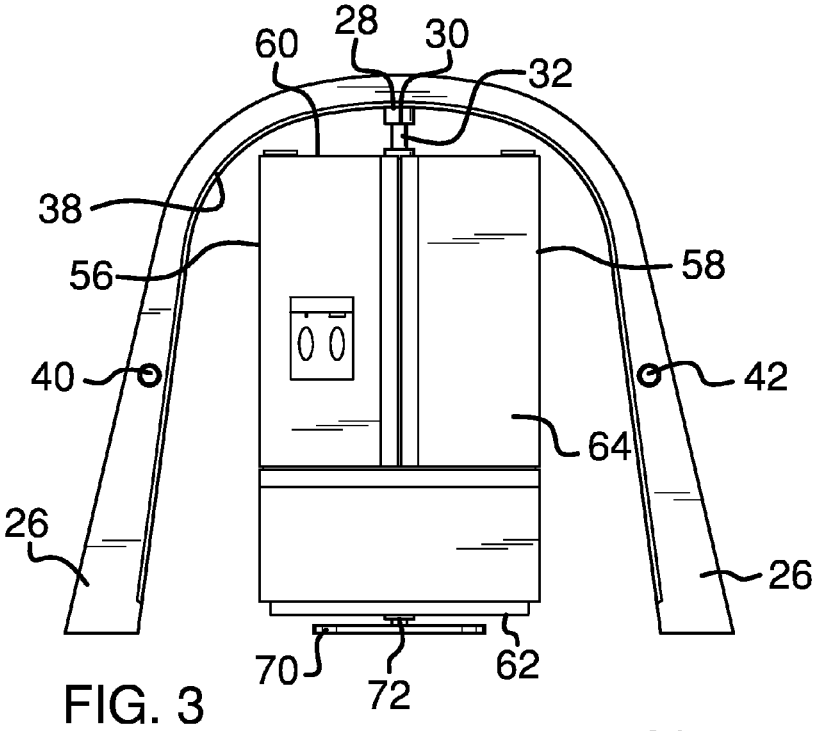
FIG. 3 is a front elevation view.
Figure 4:
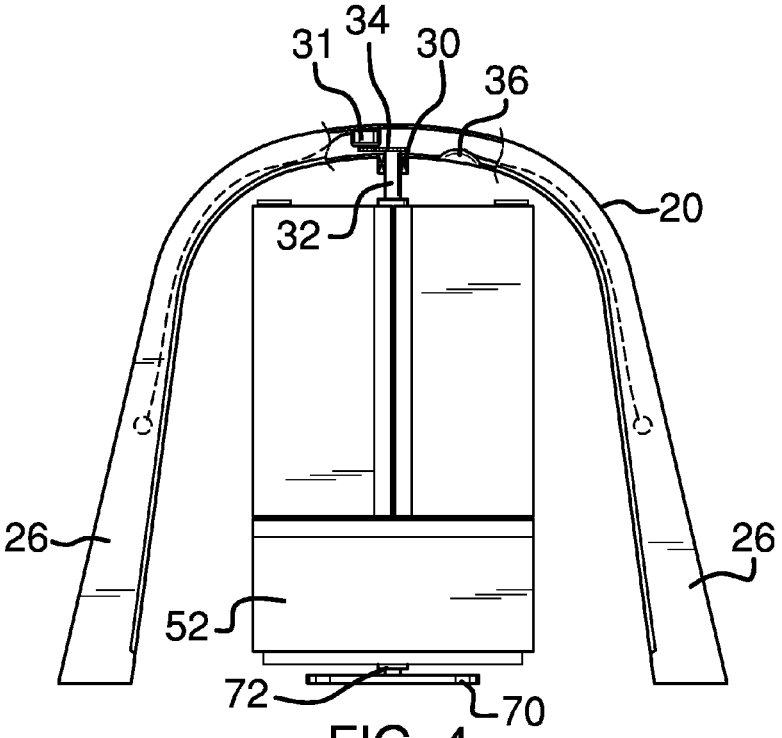
FIG. 4 is a rear elevation view.
Figure 5:
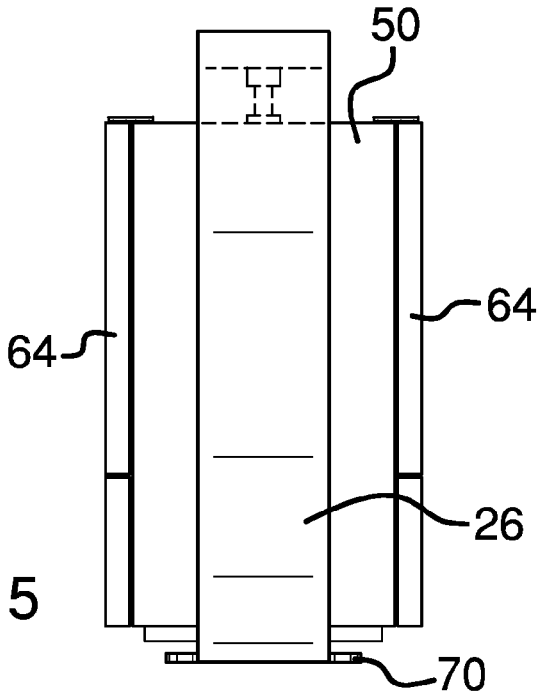
FIG. 5 is a side elevation view.
Figure 6:
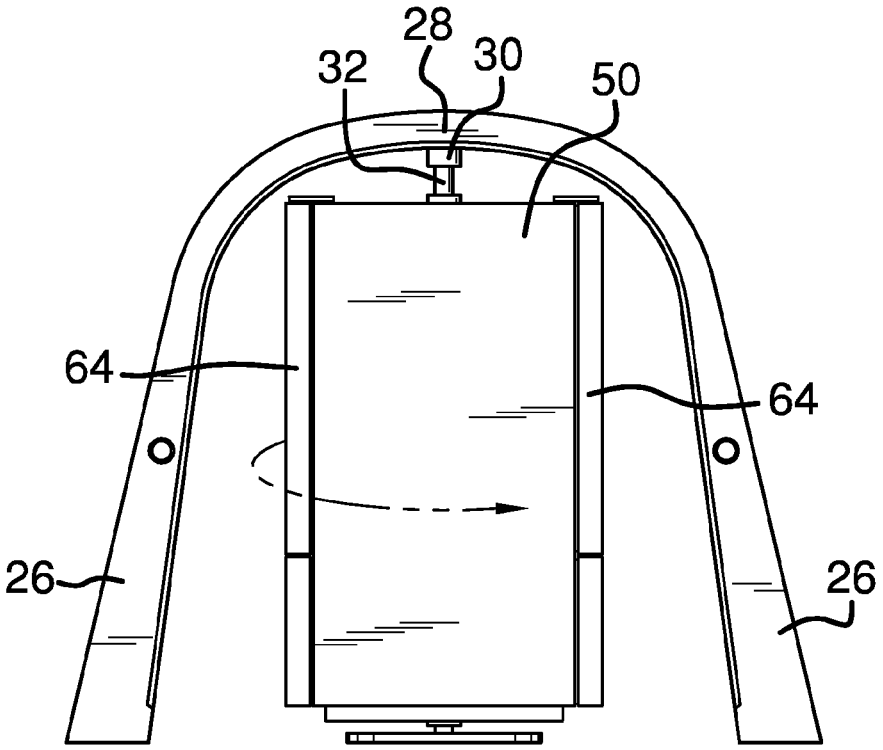
FIG. 6 is a front elevation view of a U-frame showing a refrigerator rotated to a side.

With reference now to the drawings, and in particular FIGS. 1 through 6 thereof, an example of the revolving framed refrigerator device employing the principles and concepts of the present revolving framed refrigerator device and generally designated by the reference number 10 will be described.

Referring to FIGS. 1 through 6, the revolving framed refrigerator device 10 comprises an inverted U frame 20 having an interior side 22, a top end 24, a pair of spaced apart legs 26, and a center 28. A bearing 30 is disposed within the center 28 and extended through the interior side 22. A motor 31 is disposed within the frame 20 proximal the center 28. An axle 32 is disposed within the bearing 30. A geared connection 34 connects the motor 31 to the axle 32.

A light 36 is disposed within the interior side 22 proximal the center 28. A trim light 38 is disposed substantially throughout the interior side 22. A light control 40 is ii disposed on one leg 26. The light control 40 is in operational communication with the light 36 and the trim light 38. A rotation control 42 is disposed on one leg 26. The rotation control 42 is in operational communication with the motor 31.

A multi-doored refrigerator 50 is disposed within the frame 20. The refrigerator 50 has a front side 52 spaced apart from a back side 54, a first side 56 spaced apart from a second side 58, and a top side 60 spaced apart from a bottom side 62. The axle 32 is connected to the top side 60. A plurality of doors 64 is disposed on the front side 52. A plurality of doors 64 is disposed on the back side 54. A bearinged base 70 is disposed immediately adjacent the bottom side 62. The rotation control 42 rotates the refrigerator 50 to a desired position.

What is claimed is:

1. A revolving framed refrigerator device comprising:
an inverted U frame having an interior side, a top end, a pair of spaced apart legs, and a center;
a motor disposed within the frame proximal the center;
a rotation control disposed on one leg, the rotation control in operational communication with the motor;
a multi-doored refrigerator disposed within the frame, the refrigerator having a front side spaced apart from a side, a first side spaced apart from a second side, a top side spaced apart from a bottom side, the top side connected to the motor;
a plurality of doors disposed on the front side;
a plurality of doors disposed on the back side; and
a bearinged base:
wherein the rotation control rotates the refrigerator to a desired position.

2. A revolving framed refrigerator device comprising:
an inverted U frame having an interior side, a top end, a pair of spaced apart legs, and a center;
a bearing disposed within the center and extended through the interior side;
a motor disposed within the frame proximal the center;
an axle disposed within the bearing;
a geared connection connecting the motor to the axle;
a light disposed within the interior side proximal the center;
a trim light disposed substantially throughout the interior side;

a light control disposed on one leg, the light control in operational communication with the light and the trim light;

a rotation control disposed on one leg, the rotation control in operational communication with the motor;

a multi-doored refrigerator disposed within the frame, the refrigerator having a front side spaced apart from a back side, a first side spaced apart from a second side, a top side spaced apart from a bottom side, the top side connected to the axle;

a plurality of doors disposed on the front side;

a plurality of doors disposed on the back side; and a bearinged base:

wherein the rotation control rotates the refrigerator to a desired position.

* * * * *